US005593370A

United States Patent [19]

Meldeau

[11] Patent Number: 5,593,370

[45] Date of Patent: Jan. 14, 1997

[54] COMBINED STEPPING AND SLIDING EXERCISE APPARATUS

[76] Inventor: William B. Meldeau, 200 Pacific Coast Hwy., #245, Huntington Beach, Calif. 92648

[21] Appl. No.: 546,091

[22] Filed: Oct. 19, 1995

[51] Int. Cl.[6] ..... A63B 23/04

[52] U.S. Cl. ..... 482/51; 482/52; 482/908; 472/90

[58] Field of Search ..... 482/51, 70, 71, 482/52, 908; 242/67.1 R, 67.4; 472/90, 91

[56] References Cited

U.S. PATENT DOCUMENTS 5,342,260 8/1994 Markland ..... 482/51

5,425,691 6/1995 Van Derhoeven ..... 482/52

*Primary Examiner*—Jerome Donnolly

*Attorney, Agent, or Firm*—Aquilino & Welsh

[57] ABSTRACT

An aerobic exercise platform including a bench step portion and a slick slider surface attached to the step portion for stepping and sliding exercises whereby a user may exercise with the step portion only, slide portion only and/or combine the two. The exercise platform may include several levels of bench steps with the slide portion connected adjacent the uppermost level.

10 Claims, 2 Drawing Sheets

COMBINED STEPPING AND SLIDING EXERCISE APPARATUS

BACKGROUND OF THE INVENTION

The present invention relates to exercising equipment and, in particular, to a stepping exercise device combined with a sliding exercise device. The popularity of aerobic stepping platforms and sliding platforms are well known both for use in health and fitness clubs and in home environments. Among the number of patents on these types of devices are the patents to Van Der Hoeven, U.S. Pat. No. 5,322,490, for a stepping and sliding exerciser, U.S. Pat. No. 5,154,678 to Adamczyk et al. for a combined exercise platform, U.S. Pat. No. 5,176,596 to Ullman for an easy storing three-position step stool, U.S. Pat. No. 5,275,579 to Wilkinson for an aerobic climbing step bench and U.S. Pat. No. 5,318,489 to Irwin for an adjustable stepper structure for aerobic exercises.

SUMMARY OF THE INVENTION

The present invention relates to an improvement of these type of exercise devices. An aerobic climbing step bench or stool, having at least one and preferably a plurality of levels, is combined with a slick sliding surface adjacent the uppermost level to enable the user to perform either stepping exercises, sliding exercises or a combination of the two. The topmost level of the exerciser includes a slick sliding surface positioned between two gripping step surfaces on at least two sides of the unit. In a preferred embodiment, the sliding surface is slightly concave to retain a user on the top surface.

Among the objects of the present invention are the provision of a combined aerobic stepping and sliding exerciser which combines the features of both in a single unit. A further object of the present invention is the provision of a combined stepping and sliding exerciser having a variety of heights to accommodate the needs of a user.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
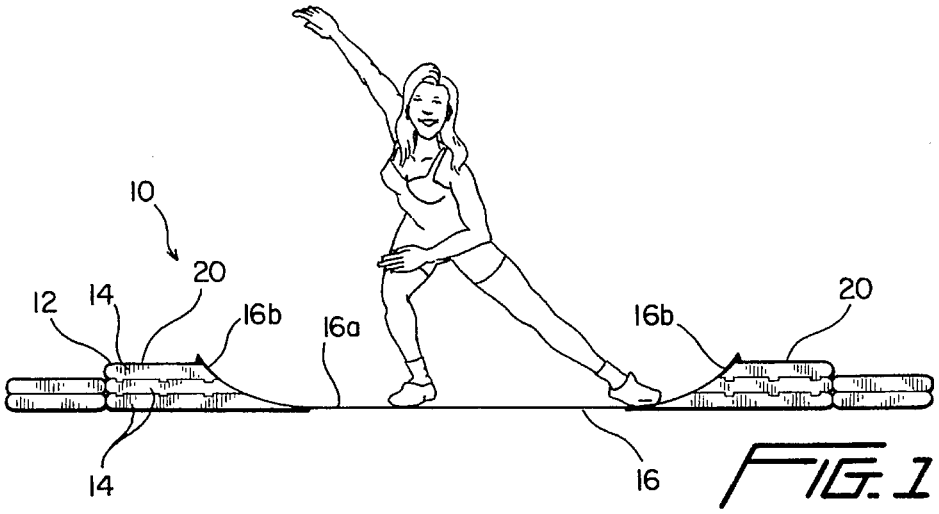
FIG. 1 is a front elevational view of the present invention with a user exercising thereon.
Figure 2:
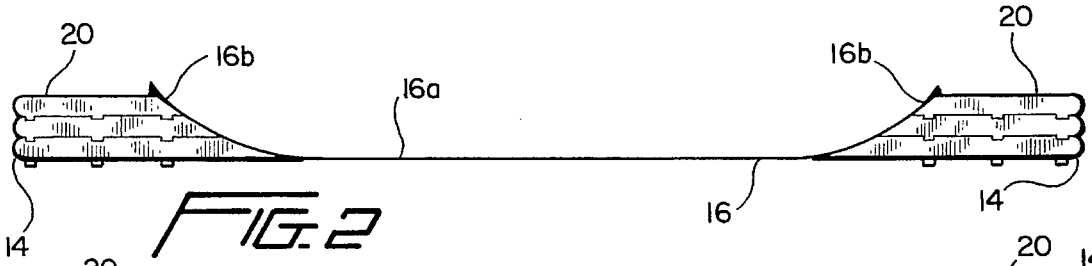
FIG. 2 is a front elevational view of the present invention.
Figure 3:
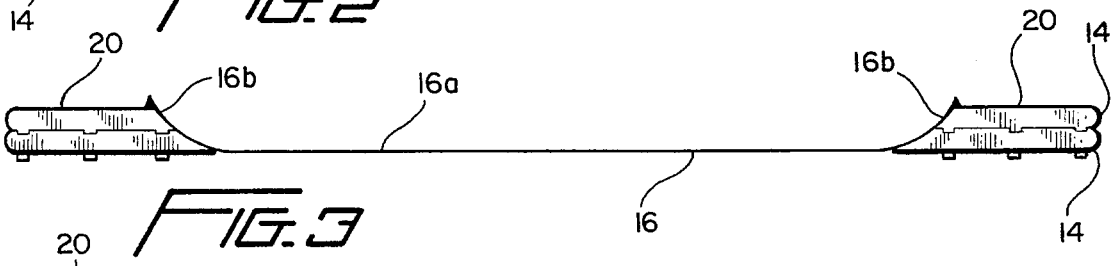
FIG. 3 is an elevational view of another embodiment of the present invention.
Figure 4:
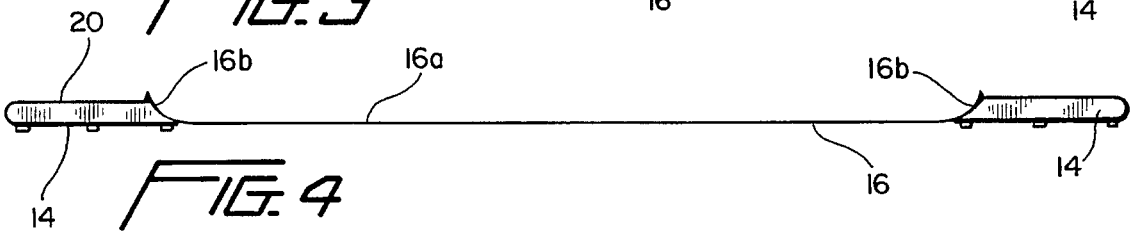
FIG. 4 is an elevational view of still another embodiment of the present invention.
Figure 5:
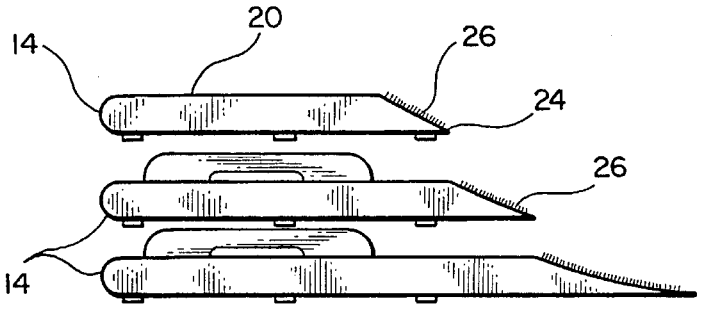
FIG. 5 is an exploded view of a detail of the invention.
Figure 6:
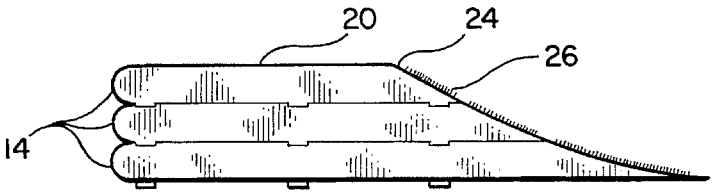
FIG. 6 is a view of a detail of the invention.
Figure 7A:
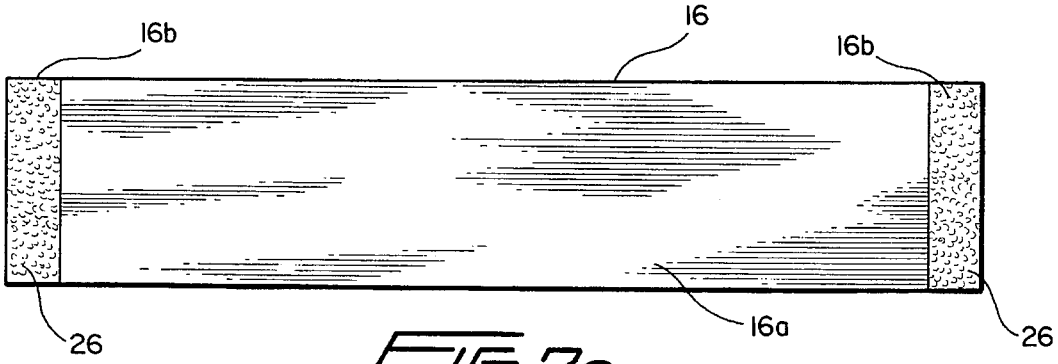
FIG. 7*a* is a top view of the slider section of the invention.
Figure 7B:
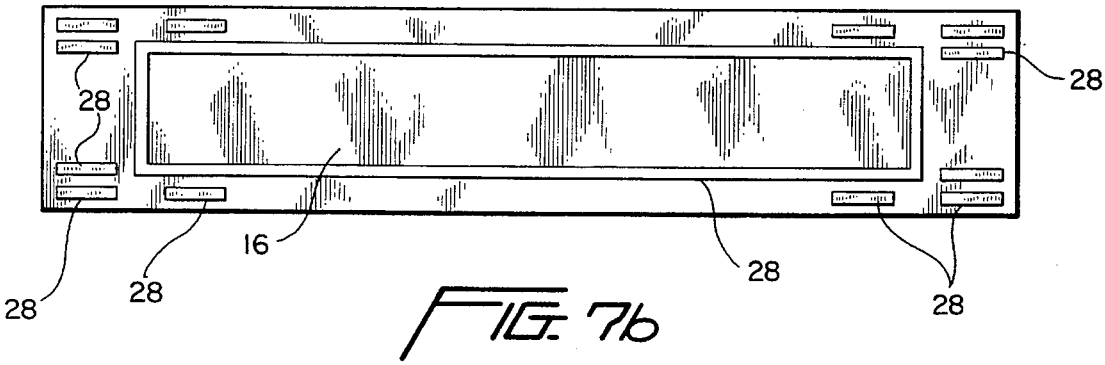
FIG. 7*b* is a bottom view of the slider section of the invention.

Referring to the drawings, FIG. 1 shows a combination step and slide exerciser 10 which may be used for aerobic exercising whereby a user can step upwardly and downwardly, and/or slide on the top of the exerciser 10. A step bench 12 is formed of a series of laterally placed stepping platforms 14. A slider 16, having a central sliding area 16*a* and opposite ends 16*b*, is connected between opposite sides of the step benches 12 whereby the user may slide between them. It will be appreciated that the step benches 12 may have a preselected number of stepping platforms 14 for height adjustment. Two or three stepping platforms 14 are most commonly used, as shown in FIGS. 2 and 3 of the drawings. A single step bench 12 may be used as shown in FIG. 4.

Preferably each stepping platform 14 has an uppermost foot engaging, stepping area 20 which is generally rectangular in configuration and a side surface 24 which is angular with respect to the top stepping area 20. The slider 16 includes rubber gripping members 28 on a bottom surface thereof to engage a support surface so it will not slip when it is used. The slider 16 is attached to the angular side surface 24 of the step bench 12, preferably with a hook and loop type separable fastener 26 or similar connecting device. An opposite end 16*b* of the slider 16 is connected to a corresponding stepping platform 14, which preferably is a mirror image of the first. When multiple stepping platforms 14 are used, they are sized to be compatible with each other, such that the angled side surfaces 24 form a continuous smooth surface for attachment to the slider 16.

Figure 8A:
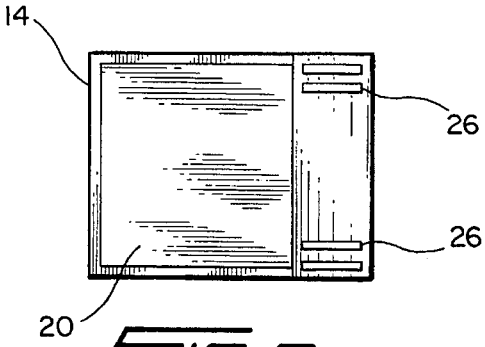
FIG. 8*a* is a top view of an upper step section of the invention.
Figure 9A:
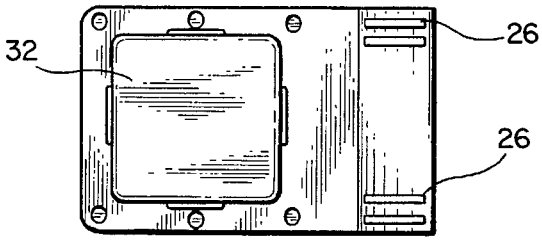
FIG. 9*a* is a top view of a lower step section of the invention.
Figure 8B:
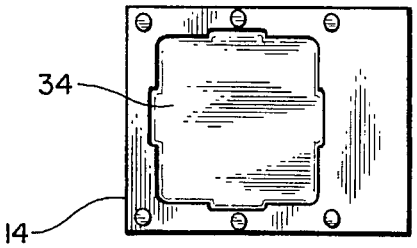
FIG. 8*b* is a bottom view of the section of FIG. 8*a*.
Figure 9B:
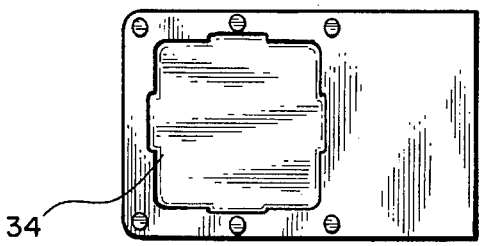
FIG. 9*b* is a bottom view of the section of FIG. 9*a*.

It will be appreciated that a variety of different step bench 12 configurations, well known in the art, may be used whereby upper and lower steps are attachably matched so as not to slide relative to each other. In the exploded views shown in FIG. 8 and 9, it can be seen that a central section 32 formed on the top surface of a first stepping platform 14 fits into a corresponding recess 34 formed in the bottom of another stepping platform 14 positioned above it, in order to create a solid connection therebetween. Preferably, each stepping platform 14 is of lightweight material which is easily transported and the stepping platforms 14 are interchangeable, each with the others. The central slider 16 is formed of a plastic material which is flexible and includes separable fastener members attached to the ends thereof.

In use, when one wishes to exercise with the apparatus of the invention, a selected number of stepping platforms 14 are assembled and the slider 16 is attached thereto using the separable fastener separating the stepping platforms 14 laterally creates a tension on the slider surface, allowing a user to smoothly glide over the top thereof when exercising. It will be appreciated that a user may step up and down on each of the steps 14 and also step inwardly onto the slider 16 for sliding movement thereon. Thus, the exercise equipment of the present invention combines the features of an aerobic stepping device with an aerobic sliding device, enabling a user to work a exercise program whereby both a stepping motion and sliding motion type of exercise may be performed without the necessity of using multiple exercise apparatus.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. In combination, a stepping exercise device and a sliding exercise device comprising:

at least one stepping exercise platform having a base for placement on a support surface, an upper stepping surface having a front and rear end raised above said support surface and an exterior angular side surface extending from one end of said upper stepping surface; and a sliding surface having opposite ends and a central sliding area to be supported on said support surface and having at least one of said opposite ends removably connected to said stepping exercise platform and interfacing with said exterior angular side surface of said stepping exercise platform; said sliding surface extending downwardly from said upper stepping surface to said support surface.

2. The combination of claim 1, including at least two stepping exercise platforms, each being a mirror image of the other; said sliding surface being connected between said stepping exercise platforms whereby said central sliding area of said sliding surface lies on said support surface and end portions of said sliding surface are connected to angular side surfaces of said two stepping exercise platforms.

3. The combination of claim 2 further including means for connecting said ends of said sliding surface to said angular side surfaces.

4. The combination of claim 3 wherein said connecting means are separable fasteners.

5. The combination of claim 4 wherein said separable fasteners are formed of hook and loop fastener elements.

6. The combination of claim 1 wherein said stepping exercise device is formed of a plurality of stepping exercise platforms.

7. The combination of claim 6 wherein said stepping exercise device is formed of two stepping exercise platforms.

8. The combination of claim 6 wherein said stepping exercise device is formed of three stepping exercise platforms.

9. The combination of claim 1 wherein an underside of said sliding exercise device is formed with a gripping layer.

10. The combination of claim 9 wherein said gripping layer is rubber.

* * * * *